United States Patent [19]

Leifeld

[11] Patent Number: 4,625,368

[45] Date of Patent: Dec. 2, 1986

[54] METHOD AND APPARATUS FOR OPENING AND CLEANING FIBER MATERIAL

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 646,933

[22] Filed: Sep. 4, 1984

[30] Foreign Application Priority Data

Sep. 19, 1983 [DE] Fed. Rep. of Germany ..... 3333750

[51] Int. Cl.[4] ..... D01G 9/04

[52] U.S. Cl. ..... 19/200; 19/95; 19/93; 19/205

[58] Field of Search ..... 19/83, 85, 90, 200, 19/204, 205, 91, 93

[56] References Cited

U.S. PATENT DOCUMENTS

| | | | |
|---|---|---|---|
| 401,092 | 4/1889 | Wilson | 19/93 |
| 1,077,947 | 11/1913 | Abrames et al. | 19/204 X |
| 1,658,916 | 2/1928 | Bothwell et al. | 19/44 |
| 1,770,505 | 7/1930 | Aeldert | 19/90 |
| 2,836,858 | 6/1958 | Szaloki | 19/91 |
| 2,844,847 | 7/1958 | Smith | 19/205 |
| 2,990,585 | 7/1961 | Sawyer | 19/91 X |
| 4,025,989 | 5/1977 | Naarding et al. | 19/93 |
| 4,229,286 | 10/1980 | Bridges | 19/200 |

FOREIGN PATENT DOCUMENTS

| | | | |
|---|---|---|---|
| 0214054 | 8/1960 | Austria . | |
| 1031119 | 11/1958 | Fed. Rep. of Germany . | |
| 1064396 | 8/1959 | Fed. Rep. of Germany . | |
| 1073915 | 7/1960 | Fed. Rep. of Germany . | |
| 2515780 | 10/1976 | Fed. Rep. of Germany . | |
| 2541380 | 3/1977 | Fed. Rep. of Germany . | |
| 3030278 | 11/1983 | Fed. Rep. of Germany . | |
| 0373644 | 5/1907 | France | 19/93 |
| 1220618 | 5/1960 | France | 19/90 |
| 4532782 | 3/1967 | Japan | 19/90 |
| 0013752 | of 1906 | United Kingdom | 19/90 |

*Primary Examiner*—Louis K. Rimrodt
*Attorney, Agent, or Firm*—Spencer & Frank

[57] ABSTRACT

An apparatus for opening and cleaning fiber material has a casing, a beater cylinder supported in the casing in a horizontal orientation; a grid situated underneath the cylinder; a fiber inlet opening and fiber outlet opening oriented for guiding a fiber carrying air stream parallel to the cylinder axis into, through and out of the apparatus; and a deflector plate situated within the casing above the cylinder. The casing defines above the cylinder a free space which has a height dimension being approximately at least twice the diameter of the cylinder. There is further provided an air outlet opening in an upper part of the casing above the cylinder.

10 Claims, 3 Drawing Figures

METHOD AND APPARATUS FOR OPENING AND CLEANING FIBER MATERIAL

BACKGROUND OF THE INVENTION

This invention relates to a method and an apparatus for opening and cleaning fiber material and has at least one beater cylinder which is supported in a horizontal orientation above grid bars, grids, or the like and underneath a closed casing and which is provided with fingers or pins. The apparatus has inlet and outlet openings arranged such that the fiber material is advanced to and removed from the cylinder in a direction parallel to the cylinder axis. Further, a deflector plate is arranged above the cylinder.

According to a known apparatus, two drums are enclosed in a common casing of predetermined shape. The cotton is drawn into the apparatus pneumatically and is driven by the drums over the grid resulting in a stripping of the adhering waste. Thereafter, the fiber material is thrown by one of the drums upwardly against the casing and is braked there by a regulating gate. Thereafter, the material again falls on the drums to be subjected to a second pass about the drums. By the beating effect of the drums a significant amount of dust accumulates in the air in the casing. It is a disadvantage of this arrangement that the dust is entrained with the fiber tufts and is thus reintroduced into the operating zone of the drums in the cleaning zone.

SUMMARY OF THE INVENTION

It is an object of the invention to provide an improved method and apparatus of the above-outlined type which ensures an improved cleaning of the fiber tufts and an effective removal of dust.

This object and others to become apparent as the specification progresses, are accomplished by the invention, according to which, briefly stated, the casing encloses, above the cylinders, a free space having a height at least approximately twice the diameter of one cylinder and further, an air outlet (suction) is provided in the upper part of the casing.

The apparatus according to the invention is, for example, of the "axial flow" type where the material is driven between two cooperating, parallel-spaced cylinders along the longitudinal axes thereof. It is feasible, however, to work in such an apparatus with a single cylinder. According to the invention, the space for the flight of material over the beaters, drums, cylinders or the like is upwardly significantly increased. The air outlet opening provided according to the invention is expediently coupled to the intake side of a blower. In this manner, there is achieved an effective removal of air laden by dust which is freed during the cleaning process.

Advantageously, the cross-sectional area of the suction outlet opening is variable, for example, by a sliding gate. It is of advantage to provide the deflector plate which expediently extends over the entire width (diametrical dimension) of the cylinder, with openings, for example, holes, slots or the like. It is preferred to arrange an air inlet opening underneath the air removal opening, in the upper zone of the casing. Advantageously, the air inlet opening whose cross-sectional area is preferably variable, is provided in the side wall of the casing approximately at the height of the cylinder or it is provided in the duct upstream of the tuft inlet opening in the cleaning apparatus.

The method according to the invention for opening and cleaning fiber material with at least one cylinder wherein the fiber tufts, for the purpose of cleaning, are conveyed in an air stream over beaters and grids, is characterized in that a partial air stream is drawn away above the beaters (drums or cylinders) and above the outlet opening for the tuft conveying air stream. One part of the air supplied to the axial flow type cleaning apparatus may be withdrawn therefrom by means of a fan through the air suction opening. By virtue of the beating effect of the cylinders a significant amount of dust dwells in the air in the inner space of the machine. This dust is drawn away by the dust removing fan and is guided through a filter. The dust removing fan may aid the material supply to the cleaning apparatus and thus removes some of the load from the conveyor fan. This is particularly advantageous if long conduits and large resistances have to be overcome as it is frequently the case between a bale opening apparatus and a successive cleaning equipment. The invention resolves the problem derived from the fact that for the positive conveyance of the tufts large quantities of air are necessary which results in high air speeds through the axial flow type cleaning apparatus. Such high air speeds decrease the cleaning effect because the fiber tufts are driven in a spiral course about the beaters over the grids and the pitch of the helix and thus the number of passes over the grids depends from the speed of air in the axial direction. This speed should be so set that a positive conveyance is just ensured to obtain the best cleaning effect. By branching off the air from the space above the cylinder, despite the high air supply speed, a small axial air speed in the cleaning apparatus can be achieved and thus besides the dust removing effect, a better cleaning effect is accomplished. In cases where a small axial speed through the cleaning apparatus is already ensured by other means, the air quantities for dust removal may be introduced as fresh air through an appropriate air inlet opening immediately upstream of or directly into the axial flow type cleaning apparatus. This opening as well as the air removal opening for the dust laden air is preferably adjustable in its cross-sectional area.

DESCRIPTION OF THE PREFERRED EMBODIMENTS

Figure 1:
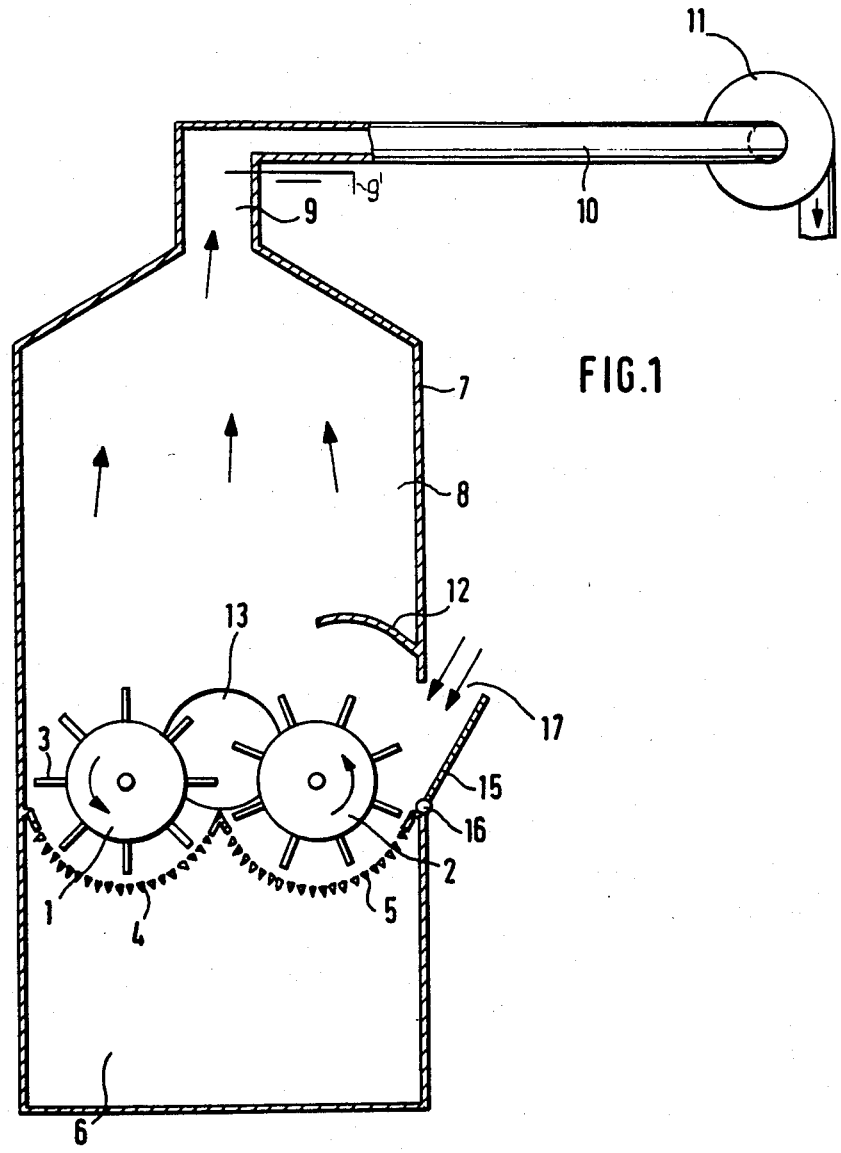
FIG. 1 is a schematic sectional elevational view of a preferred embodiment of the invention.

Turning now to FIG. 1, there is illustrated therein a fiber tuft cleaning machine of the axial flow type disclosed in German Pat. No. 1,073,915. The cleaning machine has two horizontally oriented beater drums 1 and 2 which may have, for example, a length of 1200 mm and a base diameter of 400 mm. The circle circumscribable about the pins or fingers 3 is 600 mm. The drums 1 and 2 are both situated approximately at the height of 1 m from the floor. Their distance from one another is so designed that the beater fingers 3 of the one and the other drum 1 and 2 are almost in a contacting relationship. The fingers 3 are distributed helically about the circumference of the drums. Underneath the lower half of the drums 1 and 2 there are situated respective grids 4 and 5 formed, for example, of 25 grid bars each. The two grids 4 and 5 abut one another end-to-end. Underneath the grids 4 and 5 there is provided a waste collecting chamber 6. Above the drums 1 and 2 there is provided a casing 7 of predetermined configuration. The casing 7 encloses a free space 8 which has a height which is, for example, four times the diameter of either drum 1 or 2. At the upper part of the casing 7 there is provided an air outlet opening 9 which is joined to the low pressure side of a blower 11 by means of a conduit 10 and whose flow passage is controlled, for example, by a gate 9'. The blower 11 is coupled to a filter (not shown). Above the drum 2 the inside of the casing 7 supports a deflector plate 12 (regulating gate) which extends parallel to the axis of the drums.

The cotton tufts are, by means of vacuum generated by a fan (not shown), drawn into the apparatus and enter directly, without any additional feeding device, into the effective zone of the beater fingers 3. The tufts are thereafter moved by the drum 1 downwardly over the grid 4 and are taken over by the drums 2 and pushed over the grid 5 whereby the adhering impurities are separated and thrown out through the grids 4 and 5. Thereafter, the material is thrown upwardly by the drum 2 and is braked by the deflector plate 12 whereupon the material again falls downwardly onto the drums 1 and 2 in order to repeat a second pass around the drums in a similar manner.

By virtue of the particular arrangement of the fingers 3 on the drums 1 and 2, the cotton material travels along a helix of 2 to 2½ revolutions through the cleaning machine prior to passing through the outlet opening 13 for further conveyance. In a lateral wall of the casing 7 at the height of the drums 1 and 2 there is arranged a gate 15 which is adjustable by means of a pivotal support 16 and which controls an air inlet opening 17 for allowing the intake of fresh air. During the opening and cleaning process, above the drums 1 and 2 dust accumulates which is drawn off through the air suction opening 9. The latter is arranged at such a height above the drums 1, 2 that no fiber tufts may be drawn off therethrough.

Figure 2:
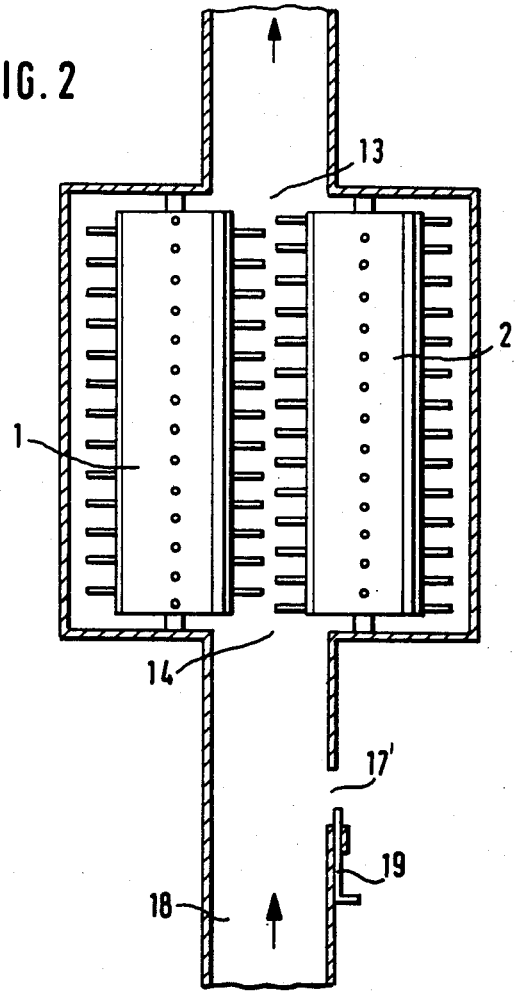
FIG. 2 is a schematic top plan view of another preferred embodiment of the invention.

Turning now to FIG. 2, in the embodiment illustrated therein, the air inlet opening 17' is provided in the lateral wall of the material supply duct 18 upstream of the tuft inlet opening 14. The air inlet opening 17' is controlled by a sliding gate 19.

Figure 3:
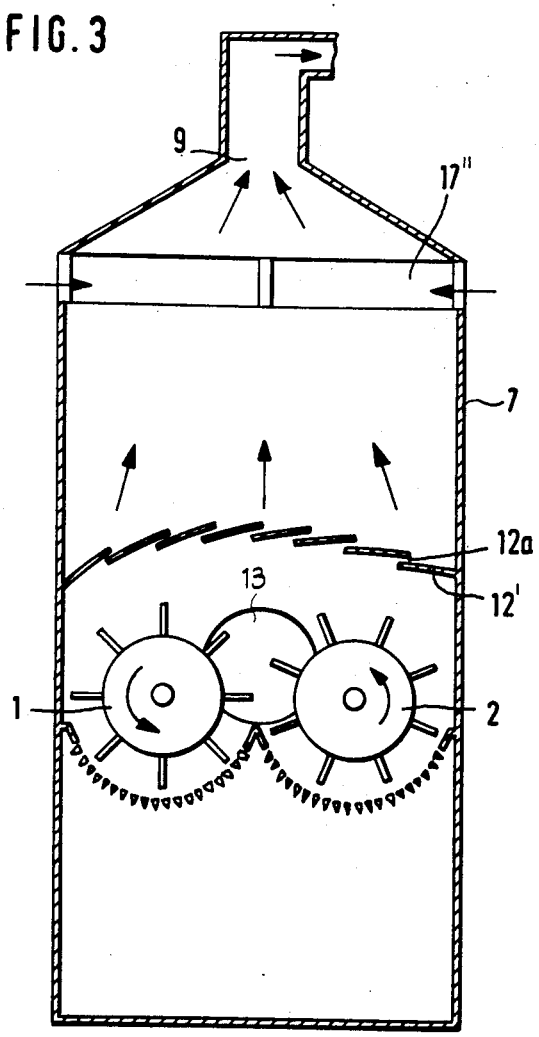
FIG. 3 is a schematic sectional elevational view of still another preferred embodiment of the invention.

In the embodiment shown in FIG. 3, the deflector plate 12' is provided with throughgoing narrow slots **12*a* which permit passage of dust-laden air but do not permit the fiber tufts to pass therethrough. The deflector plate 12' extends over the entire width of the drums 1, 2. A plurality of air inlet openings 17'' in the upper zone of the casing provide a short-length vacuum path between the air inlet openings 17'' and the air outlet 9. The rising air is captured by the vacuum flow and is withdrawn thereby. By ensuring a spatial relationship of the air inlet openings 17'' from the drums 1, 2, from the tuft inlet opening 14 (not visible in FIG. 3) and the tuft outlet opening 13**, the tuft conveying air stream remains unaffected. In this manner, there are provided in essence two independent air streams, namely, the tuft conveying air stream and the dust removal air stream.

It will be understood that the above description of the present invention is susceptible to various modifications, changes and adaptations, and the same are intended to be comprehended within the meaning and range of equivalents of the appended claims.

What is claimed is:

1. In an apparatus for opening and cleaning fiber material, including a casing, a beater cylinder having a longitudinal axis and being supported in said casing in a horizontal orientation; a grid situated underneath said cylinder; means defining a fiber inlet opening and a fiber outlet opening oriented for guiding a fiber carrying air stream parallel to said axis into, through and out of the apparatus; and a deflector plate situated within the casing above said cylinder; the improvement wherein said casing defines a free space above said cylinder, said free space having a height dimension being approximately at least twice the diameter of said cylinder and further comprising means defining an air outlet opening in an upper part of said casing above said cylinder and suction means in communication with said air outlet opening for withdrawing one part of the air from the fiber carrying air stream through said air outlet opening.

2. An apparatus as defined in claim 1, further comprising means for varying a cross-sectional passage area of said air outlet opening.

3. An apparatus as defined in claim 1, further comprising means defining apertures in said deflector plate.

4. An apparatus as defined in claim 1, wherein said deflector plate extends substantially over the entire width of said cylinder.

5. An apparatus as defined in claim 1, further comprising means defining an air inlet opening below said air outlet opening.

6. An apparatus as defined in claim 5, wherein said air inlet opening is situated in an upper zone of said casing above said cylinder.

7. An apparatus as defined in claim 5, wherein said casing has a lateral wall; said air inlet opening being provided in said lateral wall approximately at a height level of said cylinder.

8. An apparatus as defined in claim 5, further comprising a duct coupled to said fiber inlet opening for supplying the fiber carrying air stream thereto; said air inlet opening being provided in said duct upstream of said fiber inlet opening as viewed in the direction of flow of said fiber carrying air stream.

9. An apparatus as defined in claim 5, further comprising means for varying a cross-sectional passage area of said air inlet opening.

10. In a method of opening and cleaning fiber material in an apparatus having a fiber inlet opening and a fiber outlet opening; including the steps of passing a fiber carrying air stream through a working zone of a rotating beater cylinder in a direction parallel to the longitudinal rotary axis thereof; separating waste from the fiber material by said cylinder and ejecting waste through a grid extending below the cylinder; the improvement comprising the step of removing a partial air stream, free from fiber material, through an air outlet opening provided in the apparatus above the cylinder and the fiber outlet opening at a distance which is at least twice the diameter of said cylinder.

* * * * *